US010433093B2

(12) United States Patent
Setiawan et al.

(10) Patent No.: US 10,433,093 B2
(45) Date of Patent: Oct. 1, 2019

(54) APPARATUS AND METHOD FOR PROCESSING SOUNDFIELD DATA

(71) Applicant: Huawei Technologies Co., Ltd., Shenzhen (CN)

(72) Inventors: Panji Setiawan, Munich (DE); Wenyu Jin, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/047,098

(22) Filed: Jul. 27, 2018

(65) Prior Publication Data

US 2018/0376272 A1 Dec. 27, 2018

Related U.S. Application Data

(63) Continuation of application No. PCT/EP2016/051677, filed on Jan. 27, 2016.

(51) Int. Cl.
*H04S 7/00* (2006.01)
*G10L 19/008* (2013.01)
*G10L 19/00* (2013.01)

(52) U.S. Cl.
CPC ..... *H04S 7/302* (2013.01); *G10L 19/008* (2013.01); *G10L 2019/0012* (2013.01); *H04S 2420/01* (2013.01); *H04S 2420/11* (2013.01); *H04S 2420/13* (2013.01)

(58) Field of Classification Search
CPC ..... H04S 7/00; G10L 19/008
USPC ..... 381/300, 303
See application file for complete search history.

(56) References Cited

U.S. PATENT DOCUMENTS

2015/0043736 A1 2/2015 Olsen et al.
2015/0264510 A1 9/2015 Jin et al.

FOREIGN PATENT DOCUMENTS

CN 104170408 A 11/2014
CN 104769968 A 7/2015
WO 2013135819 A1 9/2013
WO 2014082683 A1 6/2014
WO WO-2014082683 A1 * 6/2014 ..... H04S 7/30

OTHER PUBLICATIONS

Jerome Daniel et al: "Further Investigations of High Order Ambisonics and Wavefield Synthesis for Holophonic Sound Imaging", Preprints of Papers Presented at the AES Convention, XX, XX, Mar. 22, 2003 (Mar. 22, 2003), pp. 1-18, XP007904475,.*

(Continued)

*Primary Examiner* — Melur Ramakrishnaiah
(74) *Attorney, Agent, or Firm* — Leydig, Voit & Mayer, Ltd.

(57) ABSTRACT

An apparatus for processing soundfield data is provided. The soundfield data defines a soundfield within a spatial reproduction region comprising at least one bright zone and at least one quiet zone. The apparatus comprises an applicator configured to apply a spatially continuously varying weighting function to the soundfield data in order to obtain weighted soundfield data defining a weighted soundfield, wherein the spatially continuously varying weighting function is configured to enhance the soundfield in at least one of the bright zone and the quiet zone.

20 Claims, 7 Drawing Sheets

(56) References Cited

OTHER PUBLICATIONS

Daniel et al.,"Further Investigations of High Order Ambisonics and Wavefield Synthesis for Holophonic Sound Imaging", Preprints of Papers Presented at the AES Convention, Audio Engineering Society, Convention Paper 5788, XP007904475, AES, (Mar. 22-25, 2003).
Setiawan et al.,"Compressing Higher Order Ambisonics of a Personal Stereo Soundfield," Audio Engineering Society, Convention Paper 9622, XP055309575, AES, (Oct. 2-Sep. 29, 2016).
Coleman "Optimizing the Planarity of Sound Zones", Conference:52nd International Conference: Sound Field Control—Engineering and Perception;AES, XP040633142, (Sep. 2-4, 2013).
Zha "3D multizone soundfield reproduction in the reverberant room using a spherical loudspeaker array," 2015 Asia-Pacific Signal and Information Processing Association Annual Summit and Conference (APSIPA), Asia—Pacific Signal and Information Processing Association, XP032870578, (Dec. 16-19, 2015).
Poletti, "An Investigation of 2D Multizone Surround Sound Systems," Presented at the 125th Convention 2008, Audio Engineering Society, Convention Paper 7551, AES (Oct. 2-5, 2008).
Jin et al., "Theory and Design of Multizone Soundfield Reproduction Using Sparse Methods," IEEE/ACM Transactions on Audio, Speech, and Language Processing, vol. 23, No. 12, Institute of Electrical and Electronics Engineers, New York, New York (Dec. 2015).
Jin et al, "Multizone Soundfield Reproduction Using Orthogonal Basis Expansion," ICASSP 2013, Institute of Electrical and Electronics Engineers, New York, New York (2013).
Lutzky et al, "AAC-ELD v2—The New State of the Art in High Quality Communication Audio Coding," Convention Paper 8516, Presented at the 131st Convention, AES (Oct. 20-23, 2011).
"3rd Generation Partnership Project;Technical Specification Group Services and System Aspects;Codec for Enhanced Voice Services (EVS);Detailed Algorithmic Description(Release 12)," 3GPP TS 26.445 V12.3.0, 3rd Generation Partnership Project, Valbonne, France (Jun. 2015).
Hellerud et al, "Encoding higher order ambisonics with AAC," Convention Paper 7366, Presented at the 124th Convention Amsterdam, The Netherlands, (2008).
Herre et al, "MPEG-H Audio—The New Standard for Universal Spatial / 3D Audio Coding," JAES vol. 62 Issue 12, AES, (2014).

* cited by examiner

APPARATUS AND METHOD FOR PROCESSING SOUNDFIELD DATA

CROSS-REFERENCE TO RELATED APPLICATIONS

This application is a continuation of International Application No. PCT/EP2016/051677, filed on Jan. 27, 2016, the disclosure of which is hereby incorporated by reference in its entirety.

TECHNICAL FIELD

Generally, the present disclosure relates to the field of audio signal processing and reproduction. More specifically, the present disclosure relates to an apparatus and a method for processing and reproducing soundfield data.

BACKGROUND

Spatial multizone soundfield reproduction over an extended region of space has recently drawn increased attention due to its various applications such as simultaneous car entertainment systems, surround sound systems in exhibition centers, personal loudspeaker systems in shared office space, and quiet zones in a noisy environment, where the aim is to provide listeners an individual sound environment without having to use acoustical barriers or headphones. Generally, a soundfield can be considered to describe the deviations of the local air pressure from the ambient pressure, i.e. the pressure variations, as a function of space and time caused for instance by the sound signals emitted by a plurality of loudspeakers. A multizone soundfield usually can comprise one or more acoustically bright zones and possibly several acoustically quiet zones.

A so-called "non-robustness" problem of multizone sound reproduction was identified in Poletti, M., "An investigation of 2D multizone surround sound system," Proc. AES 125th Convention Audio Eng. Society, 2008 in the form of a very obvious redundant sound between two selected regions with an amplitude even greater than the sound in the acoustically bright zone. In practice, such a behavior in a multizone soundfield can lead to unpleasant user experiences within these areas.

Thus, there is a need for improved apparatuses and methods for processing soundfield data addressing, in particular, the "non-robustness" problem described above.

SUMMARY

It is an object of the disclosure to provide an improved apparatus for processing soundfield data addressing, in particular, the "non-robustness" problem inherent to known devices and methods.

The foregoing and other objects may be achieved by the subject matter of the independent claims. Further implementation forms are apparent from the dependent claims, the description and the figures.

According to a first aspect the disclosure relates to an apparatus for processing soundfield data, wherein the soundfield data defines a soundfield within a spatial reproduction region comprising at least one acoustically bright zone and at least one acoustically quiet zone. The apparatus comprises: an applicator configured to apply a spatially continuously varying weighting function to the soundfield data in order to obtain weighted soundfield data defining a weighted soundfield, wherein the spatially continuously varying weighting function is configured to enhance the soundfield in the bright zone and/or the quiet zone.

Applying a spatially continuously, i.e. smoothly, varying weighting function to the soundfield data defining a soundfield allows solving the "non-robustness problem" hampering known devices, by enhancing the soundfield in the bright zone and/or the quiet zone.

The term "soundfield data" is used herein to refer to any data which includes information relating to directional characteristics of the sound it represents. Soundfield data can be represented in a variety of different formats, each of which has a defined number of audio channels, and requires a different interpretation in order to reproduce the sound represented. Examples of such formats include stereo, 5.1 surround sound and formats such as Higher Order Ambisonic (HOA) formats, which use a spherical harmonic representation of the soundfield.

The spatial reproduction region of the soundfield defined by the soundfield data can have a plurality of different shapes. In an implementation form the soundfield can be three-dimensional or two-dimensional with the spatial reproduction region, the bright zone and the quiet zone lying in a two-dimensional plane. In an implementation form the bright zone and the quiet zone can have spherical, cylindrical or circular shapes. Other shapes are possible.

In a first possible implementation form of the apparatus according to the first aspect as such, the apparatus further comprises a compressor configured to compress the soundfield data on the basis of a performance measure associated with the weighted soundfield.

This allows adapting the compression rate applied by the compressor to the performance measure and, thus, reducing the size of the weighted soundfield data. This is advantageous, in particular, for implementation forms, where a compression, for instance, for transmission or storing, of the weighted soundfield data is separated in time and/or space from a decompression of the compressed weighted soundfield data, for instance, for reproducing the weighted soundfield data.

In a second possible implementation form of the apparatus according to the first implementation form of the first aspect, the compressor is configured to compress the soundfield data, in case the performance measure associated with the weighted soundfield differs from a predefined performance measure threshold.

By using predefined a performance measure threshold based, for instance, on measurements using live listeners, the compressor can efficiently decide when to adjust its compression rate.

In a third possible implementation form of the apparatus according to the first or the second implementation form of the first aspect, the performance measure associated with the weighted soundfield is an acoustical contrast between the at least one bright zone and the at least one quiet zone of the weighted soundfield.

In a fourth possible implementation form of the apparatus according to the third implementation form of the first aspect, the acoustical contrast between the bright zone and the quiet zone of the weighted soundfield is based on a ratio between an average of the weighted soundfield in the bright zone and an average of the weighted soundfield in the quiet zone.

In a fifth possible implementation form of the apparatus according to the fourth implementation from of the first aspect, the acoustical contrast between the bright zone and the quiet zone of the weighted soundfield is based on the following equation:

$$\epsilon(t) = 10\log10\frac{\int_b |S(x,t)w(x)|^2 dx / D_b}{\int_q |S(x,t)w(x)|^2 dx / D_q},$$

wherein ∈(t) denotes the acoustical contrast as a function of time, S(x,t) denotes the soundfield data defining the soundfield as a function of space and time, w(x) denotes the spatially continuously varying weighting function and $D_b$ and $D_q$ denote the size of the bright region and the size of the quiet region, respectively.

In a sixth possible implementation form of the apparatus according to the first aspect as such or any one of the first to fifth implementation form thereof, the spatially continuously varying weighting function is a smoothly changing function configured to enhance the soundfield associated with the soundfield data in the bright region and the quiet region relative to the portions of the spatial reproduction region outside of the bright region and the quiet region.

In a seventh possible implementation form of the apparatus according to the first aspect as such or any one of the first to sixth implementation form thereof, the spatially continuously varying weighting function is a linear combination of a first normal distribution centered at a center of the bright zone and a second normal distribution centered at a center of the quiet zone.

A normal distribution provides a good approximation for the random movements of the head of a listener relative to the center of the bright zone and the quiet zone, respectively.

In an implementation form the spatially continuously varying weighting function can be defined by the following equation:

$$w(x) = \frac{a}{\sigma_a\sqrt{2\pi}} e^{-\frac{(\|x-O_b\|)^2}{2\sigma_a^2}} + \frac{b}{\sigma_b\sqrt{2\pi}} e^{-\frac{(\|x-O_q\|)^2}{2\sigma_b^2}},$$

wherein w(x) denotes the spatially continuously varying weighting function, $O_b$ denotes the center of the bright zone, $O_q$ denotes the center of the quiet zone and a, b, $\sigma_a$ and $\rho_b$ denote predefined weighting function parameters.

In an eighth possible implementation form of the apparatus according to the first aspect as such or any one of the first to seventh implementation form thereof, the soundfield data is encoded in the HOA B-Format.

In a ninth possible implementation form of the apparatus according to the first aspect as such or any one of the first to eighth implementation form thereof, the apparatus further comprises a memory configured to store the soundfield data to be weighted by the spatially continuously varying weighting function. This can be done on the side of the encoder or on the side of the decoder.

In a tenth possible implementation form of the apparatus according to the first aspect as such or any one of the first to ninth implementation form thereof, the apparatus further comprises a renderer, in particular at least one loudspeaker, configured to render the weighted soundfield on the basis of the weighted soundfield data.

According to a second aspect the disclosure relates to a soundfield reproduction system comprising an apparatus for processing soundfield data according to the first aspect as such or any one of the first to tenth implementation form thereof and a soundfield reproduction apparatus, wherein the soundfield reproduction apparatus is configured to receive the weighted soundfield data from the apparatus according to the first aspect and comprises a renderer, in particular at least one loudspeaker, configured to render the weighted soundfield on the basis of the weighted soundfield data.

In a first possible implementation form of soundfield reproduction system according to the second aspect as such, the soundfield reproduction apparatus further comprises a performance measure determiner configured to determine a performance measure on the basis of the weighted soundfield and to feedback the determined performance measure associated with the weighted soundfield to the compressor of the apparatus according to the first aspect.

According to a third aspect the disclosure relates to a method for processing soundfield data, wherein the soundfield data defines a soundfield within a spatial reproduction region comprising at least one bright zone and at least one quiet zone. The method comprises the step of applying a spatially continuously varying weighting function to the soundfield data in order to obtain weighted soundfield data defining a weighted soundfield, wherein the spatially continuously varying weighting function is configured to enhance the soundfield in the bright zone and/or the quiet zone.

In a first possible implementation form of the method according to the third aspect, the method comprises the further step of compressing the soundfield data on the basis of a performance measure associated with the weighted soundfield.

In a second possible implementation form of the method according to the first implementation form of the second aspect, the soundfield data is compressed, in case the performance measure associated with the weighted soundfield differs from a predefined performance measure threshold.

In a third possible implementation form of the method according to the first or the second implementation form of the second aspect, the performance measure associated with the weighted soundfield is an acoustical contrast between the at least one bright zone and the at least one quiet zone of the weighted soundfield.

In a fourth possible implementation form of the method according to the third implementation form of the second aspect, the acoustical contrast between the bright zone and the quiet zone of the weighted soundfield is based on a ratio between an average of the weighted soundfield in the bright zone and an average of the weighted soundfield in the quiet zone.

In a fifth possible implementation form of the method according to the fourth implementation from of the second aspect, the acoustical contrast between the bright zone and the quiet zone of the weighted soundfield is based on the following equation:

$$\epsilon(t) = 10\log10\frac{\int_b |S(x,t)w(x)|^2 dx / D_b}{\int_q |S(x,t)w(x)|^2 dx / D_q},$$

wherein ∈(t) denotes the acoustical contrast as a function of time S(x, t) denotes the soundfield data defining the soundfield as a function of space and time, w(x) denotes the spatially continuously varying weighting function and $D_b$ and $D_q$ denote the size of the bright region and the size of the quiet region, respectively.

In a sixth possible implementation form of the method according to the second aspect as such or any one of the first to fifth implementation form thereof, the spatially continuously varying weighting function is a smoothly changing function configured to enhance the soundfield associated with the soundfield data in the bright region and the quiet region relative to the portions of the spatial reproduction region outside of the bright region and the quiet region.

In a seventh possible implementation form of the method according to the second aspect as such or any one of the first to sixth implementation form thereof, the spatially continuously varying weighting function is a linear combination of a first normal distribution centered at a center of the bright zone and a second normal distribution centered at a center of the quiet zone.

In an implementation form the spatially continuously varying weighting function can be defined by the following equation:

$$w(x) = \frac{a}{\sigma_a\sqrt{2\pi}}e^{-\frac{(\|x-O_b\|)^2}{2\sigma_a^2}} + \frac{b}{\sigma_b\sqrt{2\pi}}e^{-\frac{(\|x-O_q\|)^2}{2\sigma_b^2}},$$

wherein w(x) denotes the spatially continuously varying weighting function, $O_b$ denotes the center of the bright zone, $O_q$ denotes the center of the quiet zone and a, b, $\sigma_a$ and $\sigma_b$ denote predefined weighting function parameters.

In an eighth possible implementation form of the method according to the second aspect as such or any one of the first to seventh implementation form thereof, the soundfield data is encoded in the HOA B-Format.

In a ninth possible implementation form of the method according to the second aspect as such or any one of the first to eighth implementation form thereof, the method comprises the further step of storing the soundfield data to be weighted by the spatially continuously varying weighting function in a memory.

In a tenth possible implementation form of the method according to the second aspect as such or any one of the first to ninth implementation form thereof, the method comprises the further step of rendering the weighted soundfield on the basis of the weighted soundfield data.

According to a fourth aspect the disclosure relates to a computer program comprising program code for performing the method according to the third aspect of the disclosure or any of its implementation forms when executed on a computer.

The disclosure can be implemented in hardware and/or software.

BRIEF DESCRIPTION OF THE DRAWINGS

Further embodiments of the disclosure will described with respect to the following figures, wherein.

In the various figures, identical reference signs will be used for identical or at least functionally equivalent features.

DETAILED DESCRIPTION OF THE EMBODIMENTS

In the following description, reference is made to the accompanying drawings, which form part of the disclosure, and in which are shown, by way of illustration, specific aspects in which the present disclosure may be placed. It is understood that other aspects may be utilized and structural or logical changes may be made without departing from the scope of the present disclosure. The following detailed description, therefore, is not to be taken in a limiting sense, as the scope of the present disclosure is defined be the appended claims.

For instance, it is understood that a disclosure in connection with a described method may also hold true for a corresponding device or system configured to perform the method and vice versa. For example, if a specific method step is described, a corresponding device may include a unit to perform the described method step, even if such unit is not explicitly described or illustrated in the figures. Further, it is understood that the features of the various exemplary aspects described herein may be combined with each other, unless specifically noted otherwise.

Figure 1:
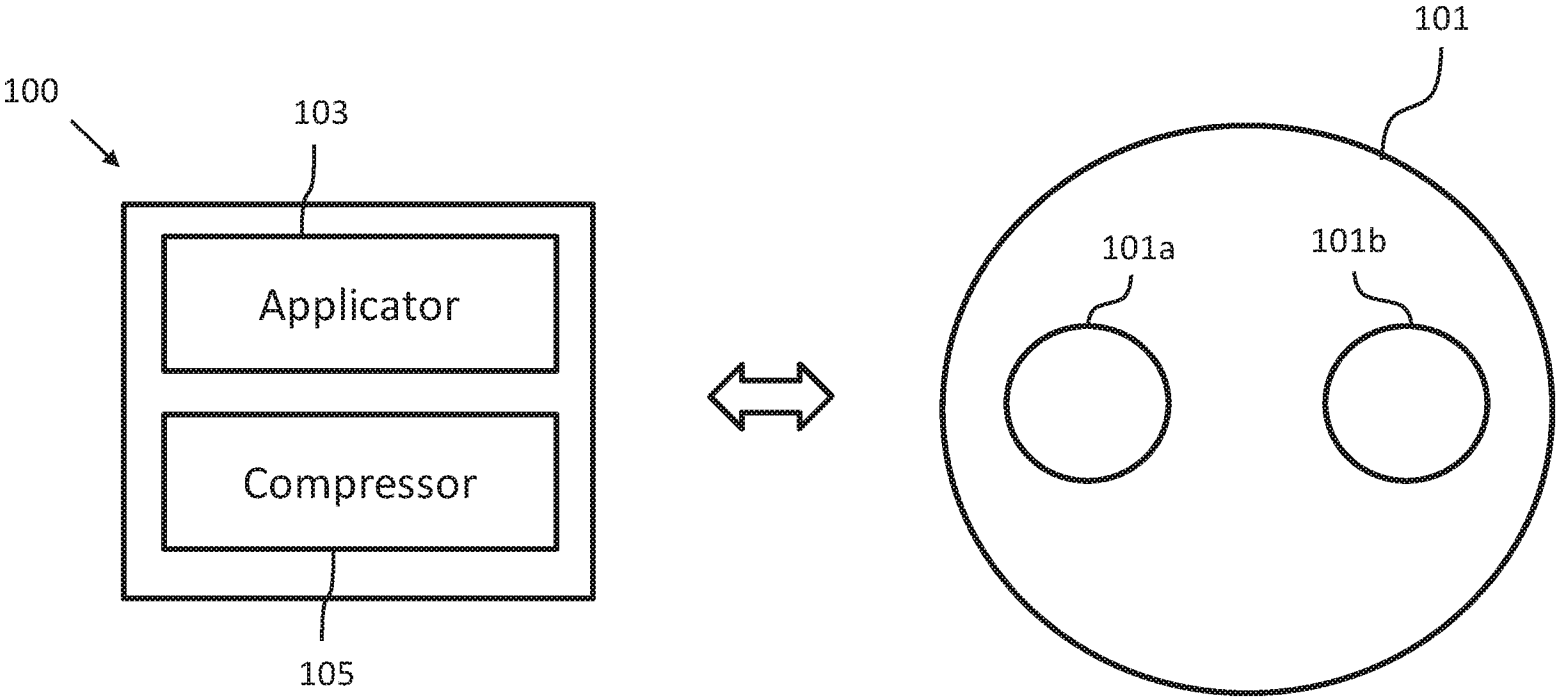
FIG. 1 shows a schematic diagram of an apparatus for processing soundfield data according to an embodiment.

FIG. 1 shows a schematic diagram of an apparatus 100 for processing soundfield data. As schematically indicated on the right hand side of FIG. 1, the soundfield data defines a soundfield within a spatial reproduction region 101 comprising at least one bright zone 101*a* and at least one quiet zone 101*b*.

The term "soundfield data" is used herein to refer to any data which includes information relating to directional characteristics of the sound it represents. Soundfield data can be represented in a variety of different formats, each of which has a defined number of audio channels, and requires a different interpretation in order to reproduce the sound represented. Examples of such formats include stereo, 5.1 surround sound and formats such Higher Order Ambisonic (HOA) formats, in particular HOA B-format.

The spatial reproduction region of the soundfield defined by the soundfield data can have a plurality of different shapes. In an implementation form the soundfield can be three-dimensional or two-dimensional with the spatial reproduction region, the bright zone and the quiet zone lying in a two-dimensional plane. In an implementation form the bright zone and the quiet zone can have spherical, cylindrical or circular shapes. Other shapes are possible.

The apparatus 100 comprises an applicator 103 configured to apply a spatially continuously varying weighting function to the soundfield data in order to obtain weighted soundfield data defining a weighted soundfield. The spatially continuously varying weighting function is configured to enhance the soundfield in the bright zone 101*a* and/or the quiet zone 101*b* of the spatial reproduction region 101.

In an embodiment, the apparatus 100 further comprises a compressor 105 configured to compress the soundfield data on the basis of a performance measure associated with the weighted soundfield.

In an embodiment, the compressor 105 is configured to compress the soundfield data, in case the performance measure associated with the weighted soundfield differs from a predefined performance measure threshold.

In an embodiment, the performance measure associated with the weighted soundfield is an acoustical contrast between the at least one bright zone 101*a* and the at least one quiet zone 101*b* of the weighted soundfield.

In an embodiment, the acoustical contrast between the bright zone 101*a* and the quiet zone 101*b* is based on a ratio between an average of the weighted soundfield in the bright zone 101*a* and an average of the weighted soundfield in the quiet zone 101*b*.

In an embodiment, the acoustical contrast between the bright zone 101*a* and the quiet zone 101*b* is based on the following equation:

$$\epsilon(t) = 10\log_{10}\frac{\int_b |S(x,t)w(x)|^2 dx / D_b}{\int_q |S(x,t)w(x)|^2 dx / D_q}, \tag{1}$$

wherein ∈(t) denotes the acoustical contrast as a function of time, S(x,t) denotes the soundfield associated with the soundfield data as a function of space and time, w(x) denotes the spatially continuously varying weighting function and $D_b$ and $D_q$ denote the size of the bright region 101*a* and the size of the quiet region 101*b*, respectively.

In an embodiment, the spatially continuously varying weighting function is a smoothly changing function configured to enhance the soundfield associated with the soundfield data in the bright region 101*a* and the quiet region 101*b* relative to the portions of the spatial reproduction region 101 outside of the bright region 101*a* and the quiet region 101*b*.

In an embodiment, the spatially continuously varying weighting function is a linear combination of a first normal distribution centered at a center of the bright zone 101*a* and a second normal distribution centered at a center of the quiet zone 101*b*. This preferred choice of the spatially continuously varying weighting function is based on the finding that, in practice, the position of the listener's head (ears) is not guaranteed to be stationary within the bright region and/or quiet region due to the movement of its body. Rather, the distribution of listener's head position can be modelled as a Gaussian distribution function of its distance to the center of the bright zone and the quiet zone, respectively. Thus, in an embodiment, the spatially continuously varying weighting function can be defined by the following equation:

$$w(x) = \frac{a}{\sigma_a\sqrt{2\pi}} e^{-\frac{(\|x-O_b\|)^2}{2\sigma_a^2}} + \frac{b}{\sigma_b\sqrt{2\pi}} e^{-\frac{(\|x-O_q\|)^2}{2\sigma_b^2}}, \tag{2}$$

wherein w(x) denotes the spatially continuously varying weighting function, $O_b$ denotes the center of the bright zone, $O_q$ denotes the center of the quiet zone and a, b, $\sigma_a$ and $\sigma_b$ denote predefined weighting function parameters.

With the above preferred choice for the weighting function the probability that the listener's head is positioned within a circle of radius r/2 from the center of the bright zone (or equivalently the center of the quiet zone) is 68.3%. With this choice of the weighting function, the system will distribute the importance of the reproduction accuracy over different zones in a more flexible and efficient manner due to the introduction of the smoothly and continuously changing weighting function. More emphasis will be attached to the region where the listener' ears are more likely to appear (e.g. the central region of the bright and quiet zone), while the reproduction effort might be distracted in some region (e.g. the edge of the bright and quiet zone) in order to alleviate the occurrence of spurious sound outside of the bright zone and the quiet zone.

Figure 2:
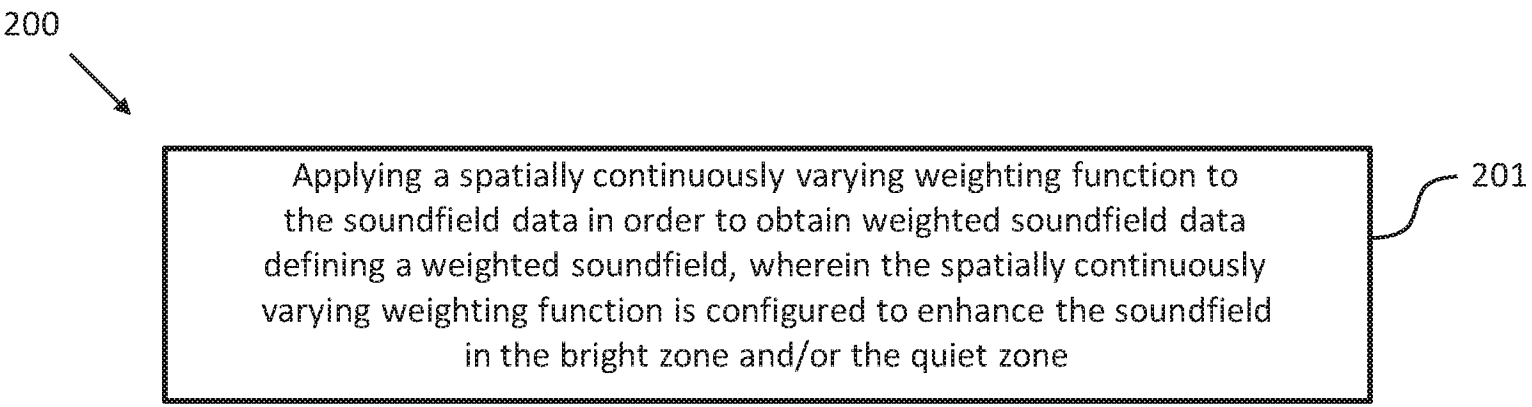
FIG. 2 shows a schematic diagram of a method for processing soundfield data according to an embodiment.

FIG. 2 shows a schematic diagram of a method 200 for processing soundfield data according to an embodiment, for instance, the soundfield data defining a soundfield within the spatial reproduction region 101 shown in FIG. 1, comprising the acoustically bright zone 101*a* and the acoustically quiet zone 101*b*.

The method 200 comprises the step 201 of applying a spatially continuously varying weighting function to the soundfield data, for instance, the spatially continuously varying weighting function defined in equation (2) above, in order to obtain weighted soundfield data defining a weighted soundfield, wherein the spatially continuously varying weighting function is configured to enhance the soundfield in the bright zone 101*a* and/or the quiet zone 101*b*.

Further implementation forms, embodiments and aspects of the apparatus 100 for processing soundfield data and the method 200 for processing soundfield data will be described in the following.

Figure 3:
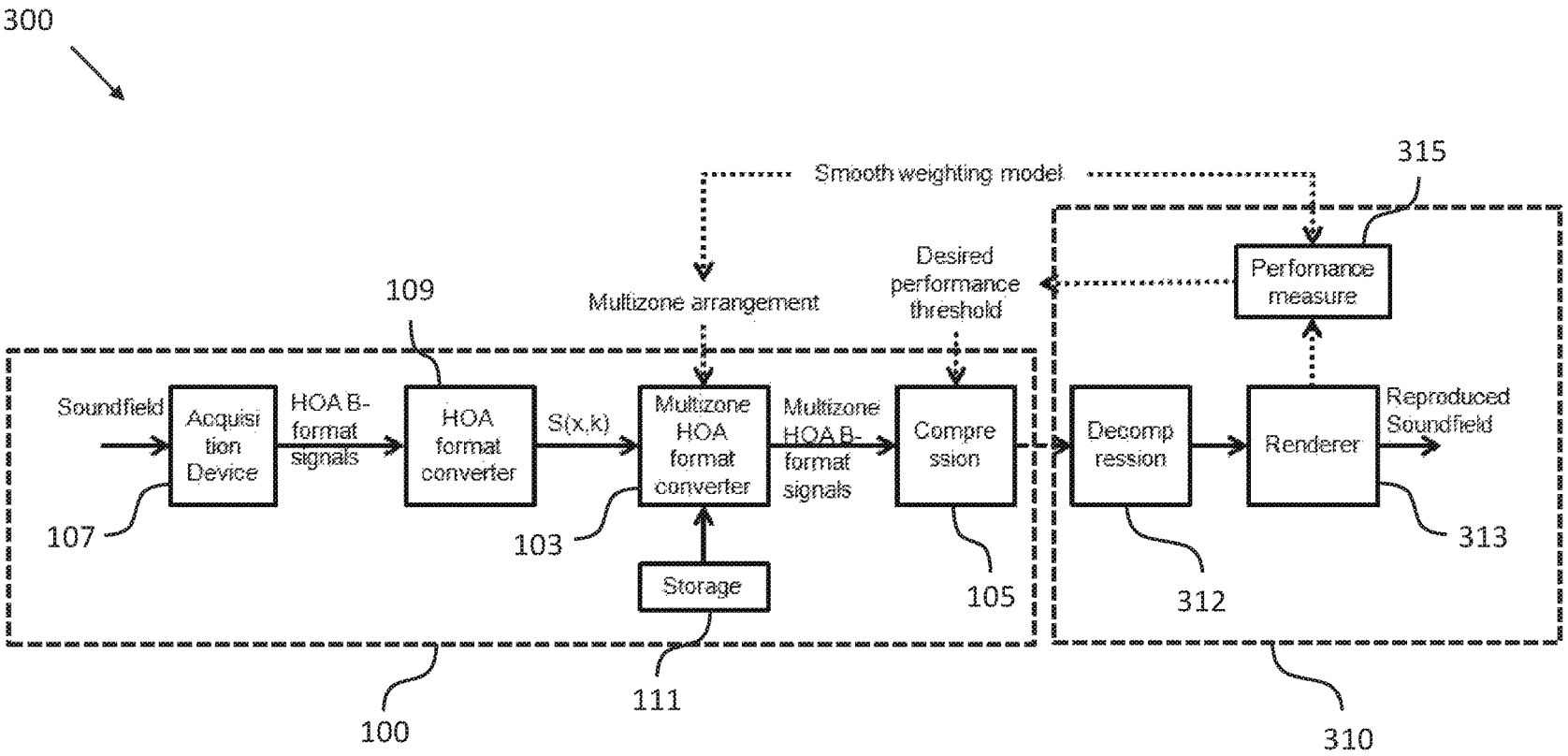
FIG. 3 shows a schematic diagram of a soundfield reproduction system according to an embodiment comprising an apparatus for processing soundfield data according to an embodiment.

FIG. 3 shows a schematic diagram of a soundfield reproduction system 300 according to an embodiment comprising an apparatus 100 for processing soundfield data according to an embodiment.

In the embodiment of the apparatus 100 for processing soundfield data shown in FIG. 3, the applicator 103 shown in FIG. 1 is referred to as a "Multizone HOA format converter" 103 and the compressor 105 shown in FIG. 1 is referred to as "Compression". In addition to the applicator 103 and the compressor 105 the embodiment of the apparatus 100 for processing soundfield data shown in FIG. 3 comprises an acquisition device 107 configured to acquire the original, i.e. non-weighted, soundfield data. In an embodiment, the acquisition device 107 can comprise one or more microphones, such as a 32-channel Eigenmike. In an embodiment, the acquisition device 107 can be a communication interface configured to receive the original, i.e. non-weighted, soundfield data from another device.

In an embodiment, the acquisition device 107 is configured to provide the original, i.e. non-weighted, soundfield data in HOA B-format to a HOA format converter 109 configured to perform a plane wave decomposition of the HOA B-format soundfield data into the spherical/circular harmonic domain resulting in the soundfield data S(x,k), wherein x denotes the position vector and k denotes the wave number, or equivalently the soundfield data S(x,t), wherein t denotes time.

The HOA format converter 109 of the embodiment of the apparatus 100 for processing soundfield data shown in FIG. 3 is configured to provide the soundfield data S(x,k) (or equivalently S(x,t)) to the applicator 103, which, as already mentioned above, in the embodiment shown in FIG. 8 is referred to as the "Multizone HOA format converter" 103. As already described in the context of the embodiment shown in FIG. 1, the applicator 103 is configured to apply a spatially continuously varying weighting function to the soundfield data provided by the HOA format converter 109 in order to obtain weighted soundfield data defining a weighted soundfield. The spatially continuously varying weighting function used by the applicator 103 is configured to enhance the soundfield in the bright zone 101*a* and/or the quiet zone 101*b* of the spatial reproduction region 101. In an embodiment, the applicator 103 is configured to provide the weighted soundfield data as HOA-B format weighted soundfield data. As schematically indicated in FIG. 3, in order to be able to perform this conversion to the HOA-B format, the applicator 103 requires as input some information about the soundfield and the weighting function, such as the location of the bright zone and/or the quit zone.

In the embodiment shown in FIG. 3, the apparatus 100 for processing soundfield data comprises in addition an electronic storage or memory 111 configured to store soundfield data to be processed by the applicator 103, i.e. to be weighted by the spatially continuously varying weighting function. Thus, in embodiments, the applicator 103 can be configured to process soundfield data provided by either one or by both of the HOA format converter 109 or the storage 111.

In the embodiment shown in FIG. 3 the weighted soundfield data generated by the applicator 103 is provided to the compressor 105, which is configured to compress the weighted soundfield data using one or more conventional compression techniques. As will be described in more detail further below, in an embodiment, the compressor 105 is configured to adapt its compression rate for compressing the weighted soundfield data on the basis of a performance measure, which is being fed back to the compressor 105 from the soundfield reproduction apparatus 310 shown in FIG. 3.

In the embodiment shown in FIG. 3 the apparatus 100 for processing soundfield data and the soundfield reproduction apparatus 310 are part of the soundfield reproduction system 300. In other embodiment, the apparatus 100 for processing soundfield data and the soundfield reproduction apparatus 310 can be separated in space and/or time. For instance, the apparatus 100 for processing soundfield data could be implemented as a web server providing the compressed weighted soundfield data over the Internet to the soundfield reproduction apparatus 310 implemented as a web client. In such a scenario the apparatus 100 for processing soundfield data can be considered to be an encoder, whereas the soundfield reproduction apparatus 310 can be considered to be a corresponding decoder.

In the embodiment shown in FIG. 3, the soundfield reproduction apparatus 310 comprises a decompressor 312 configured to decompress the compressed weighted soundfield data provided by the apparatus 100 for processing soundfield data. In case the compressor 105 and the decompressor 312 are implemented to use lossless compression techniques the decompressor 312 can fully restore the weighted soundfield data. Furthermore, the soundfield reproduction apparatus 310 comprises a renderer 313 configured to render, i.e. reproduce the weighted soundfield on the basis of the weighted soundfield data. In an embodiment, the renderer 313 can comprise one or more appropriately arranged transducers, in particular loudspeakers.

Finally, in the embodiment shown in FIG. 3, the soundfield reproduction apparatus 310 comprises a performance measure determiner 315 configured to determine a performance measure on the basis of the weighted soundfield. To this end, in an embodiment, the performance measure determiner 315 can comprise one or more microphones, such as a 32-channel Eigenmike, for measuring the weighted soundfield reproduced by the renderer 313 as well as a processing unit configured to determine a performance measure on the basis of the measured weighted soundfield, for instance, the performance measure defined in equation (1) above.

In an embodiment, the soundfield reproduction apparatus 310 is configured to feedback the performance measure determined by the performance measure determiner 315 to the compressor 105 of the apparatus 100. In an embodiment, the compressor 105 is configured to adjust its compression rate on the basis of the performance measure provided by the performance measure determiner 315. For instance, in an embodiment the compressor 105 can check, whether the performance measure provided by the performance measure determiner 315 is larger than a predefined performance measure threshold, e.g. whether the acoustical contrast between the bright region 101*a* and the quiet region is larger than a predefined minimal acoustical contrast, and, if this is the case, can increase the compression rate applied to the weighted soundfield data.

Figure 4:
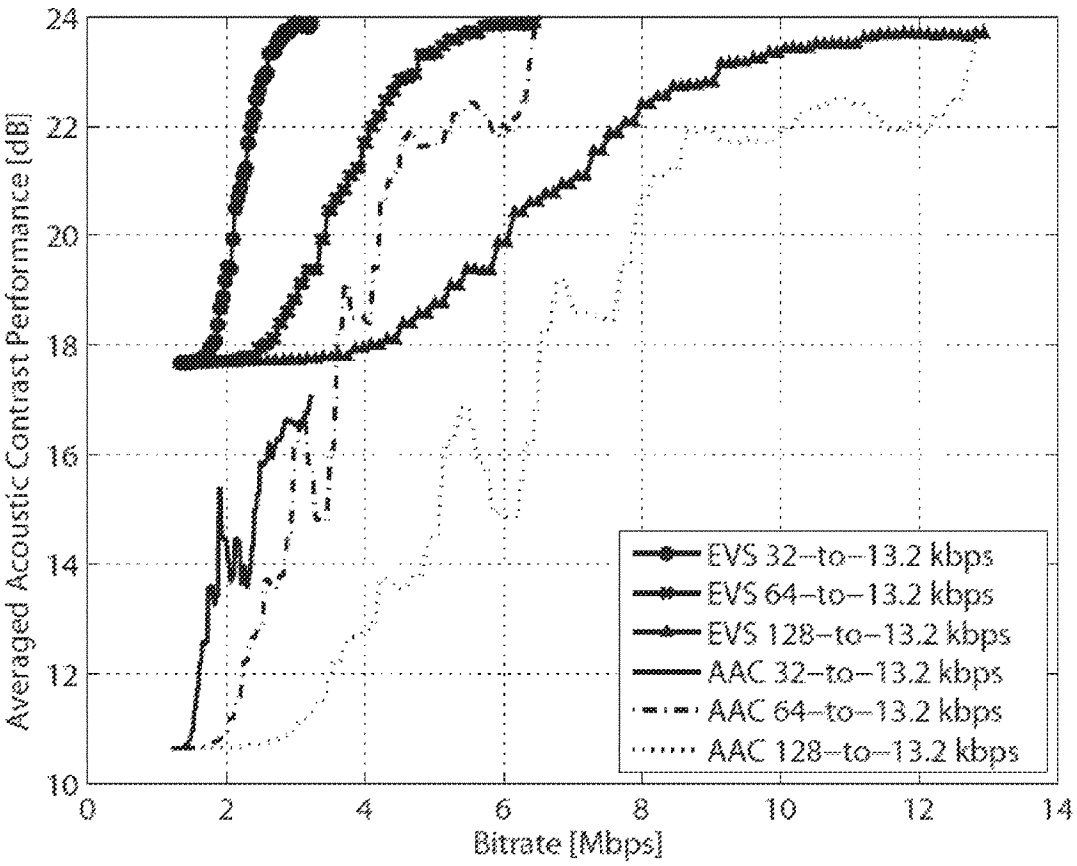
FIG. 4 shows a diagram illustrating the dependence of the averaged acoustic contrast performance as a function of a transmission bitrate for a plurality of different compression techniques that can be implemented in a soundfield reproduction system shown in FIG. 3.

In an embodiment, the compressor 105 can implement a compression strategy based on the pre-calculated graphs shown in FIG. 4, which shows the dependence of the averaged acoustic contrast performance as a function of a transmission bitrate for a plurality of different compression techniques, such as different versions of EVS and different versions of AAC. For instance, in an embodiment, the compressor 105 could be configured to increase its compression rate, in case for a given previously chosen bitrate the performance measure provided by the performance measure determiner 315, i.e. the averaged acoustic contrast performance, falls below the curve show in FIG. 4 for the compression strategy adopted by the compressor 105.

Figure 5:
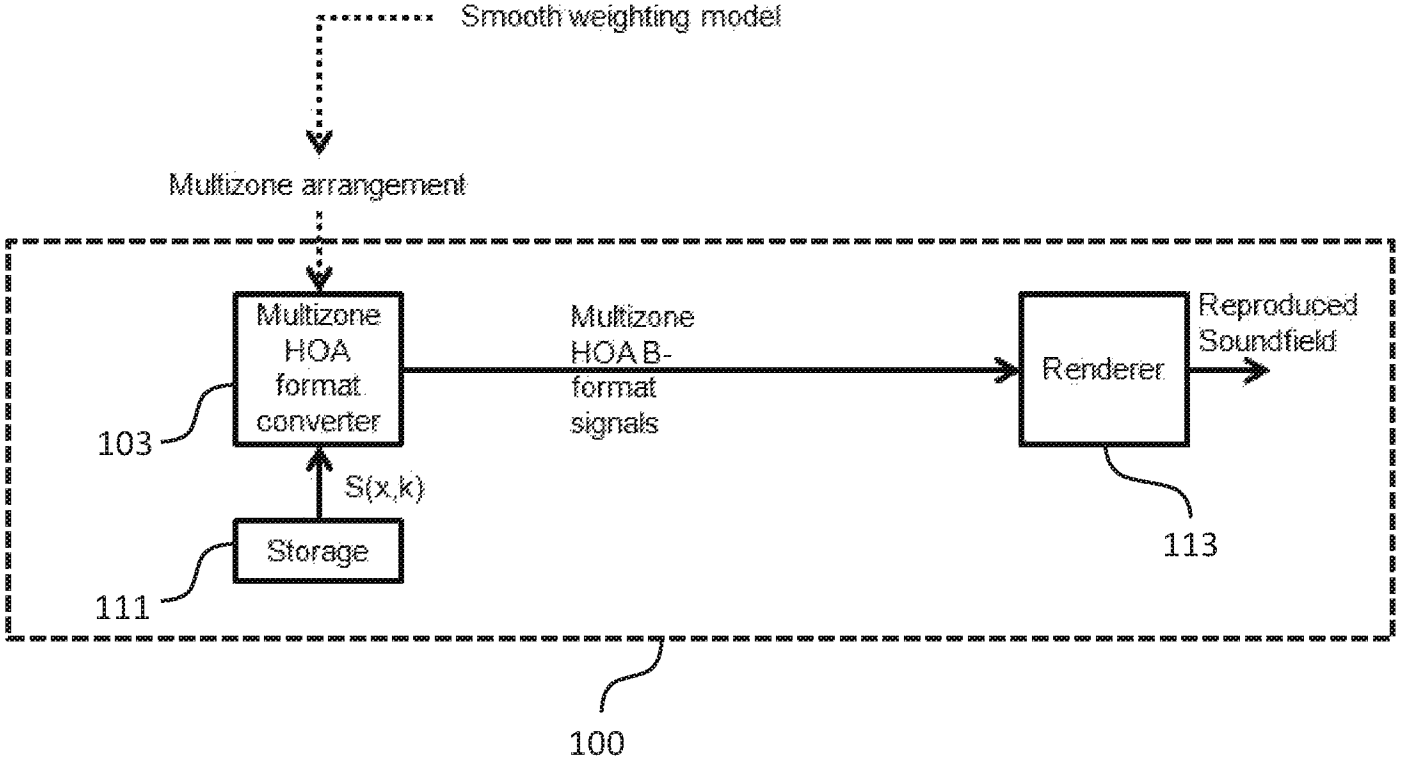
FIG. 5 shows a schematic diagram of an apparatus for processing soundfield data according to an embodiment.

FIG. 5 shows a schematic diagram of a further embodiment of an apparatus 100 for processing soundfield data. As the embodiment of the apparatus 100 for processing soundfield data shown in FIG. 1, the further embodiment of the apparatus 100 for processing soundfield data shown in FIG. 5 comprises an applicator 103 (referred to as "Multizone HOA format converter" in FIG. 5) configured to apply a spatially continuously varying weighting function to soundfield data, for instance, the spatially continuously varying weighting function defined in equation (2) above, in order to obtain weighted soundfield data defining a weighted soundfield, wherein the spatially continuously varying weighting function is configured to enhance the soundfield in the bright zone 101*a* and/or the quiet zone 101*b*. In the embodiment shown in FIG. 5, the soundfield data is taken from an electronic storage or memory 111, for instance a DVD player, a CD player or a Flash memory, configured to store the soundfield data to be weighted by the spatially continuously varying weighting function. In an embodiment, the applicator 103 is configured to provide the weighted soundfield data as HOA-B format weighted soundfield data. As schematically indicated in FIG. 5, in order to be able to perform this conversion to the HOA-B format, the applicator 103 requires as input some information about the soundfield and the weighting function, such as the location of the bright zone and/or the quit zone.

As in the embodiment shown in FIG. 5, the weighted soundfield data is provided from the applicator 103 directly to a renderer 113 configured to render, i.e. reproduce, the weighted soundfield on the basis of the weighted soundfield data, the apparatus 100 shown in FIG. 5 does not comprise a compressor, such as the compressor 105 of the apparatus shown in FIG. 1.

Figure 6:
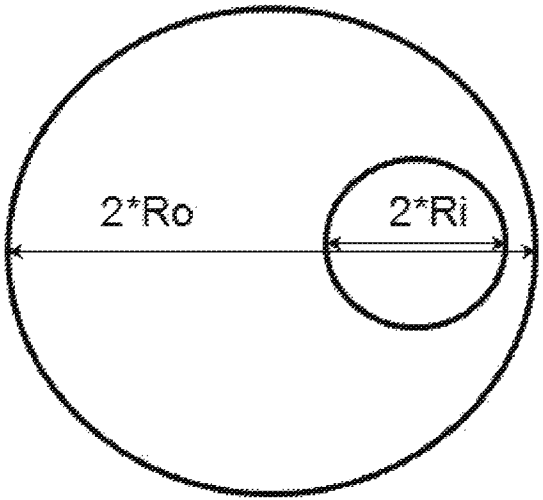
FIG. 6 shows a schematic diagram illustrating different aspects of embodiments of the disclosure.
Figure 7:
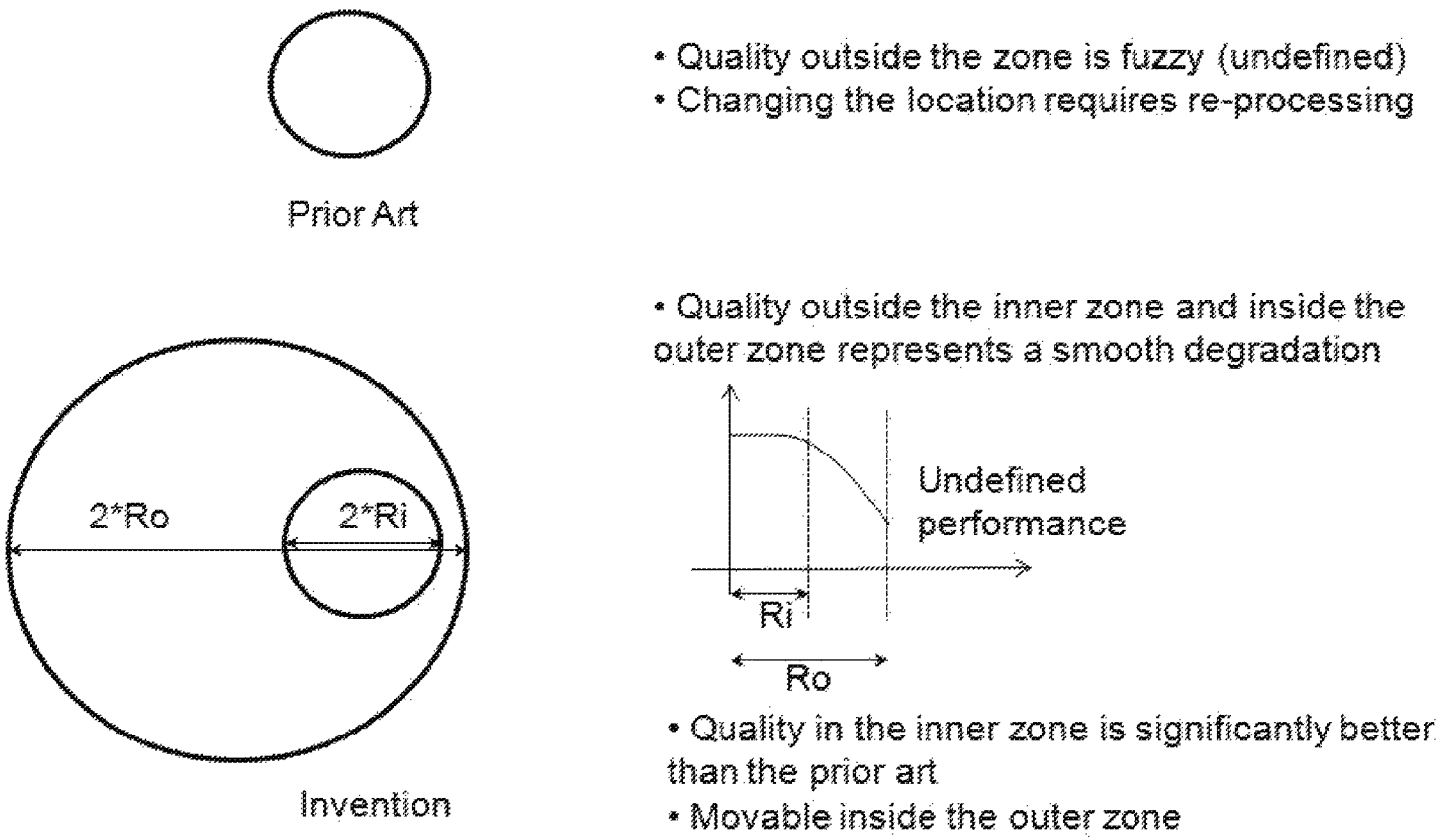
FIG. 7 shows a schematic diagram illustrating different aspects of embodiments of the disclosure.

FIGS. 6 and 7 show schematic diagrams illustrating different aspects of embodiments of the disclosure in the context of an unrestricting illustrative example. In this illustrative example it is assumed that the bright zone of the weighted soundfield has the size of a circle with diameter 2*Ro (outer zone) as shown in the FIG. 6, which generally is much larger than the size of an average human head. As already described above, according to embodiments of the disclosure, a bitrate reduction can be achieved by having a smooth weighting function/model corresponding to some criteria such as the possible user movement within the region of diameter 2*Ri (inner zone) inside the outer zone.

In multizone applications, it is practically desirable to have the size of outer zone as large as possible. One may choose to focus on the reproduction inside a smaller region denoted by the inner zone. This will make the system to be inferior due to a smaller area of coverage and reprocessing of the multizone HOA B-format signals due to a change in the multizone arrangement input, resulting in an undesired quality as the user moves away from the inner zone. Embodiments of the disclosure on the other hand, guarantee a smooth transition in quality as highlighted in FIG. 7.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the disclosure beyond those described herein. While the present disclosure has been described with reference to one or more particular embodiments, those skilled in the art recognize that many changes may be made thereto without departing from the scope of the present disclosure. It is therefore to be understood that within the scope of the appended claims and their equivalents, the disclosure may be practiced otherwise than as specifically described herein.

What is claimed is:

1. An apparatus for processing soundfield data, the soundfield data defining a soundfield within a spatial reproduction region comprising an at least one bright zone and an at least one quiet zone, the apparatus comprising:

an applicator that applies a spatially continuously varying weighting function to the soundfield data to obtain a weighted soundfield data defining a weighted soundfield, wherein the spatially continuously varying weighting function enhances the soundfield in at least one of the group consisting of: the at least one bright zone and the at least one quiet zone; and a compressor that compresses the soundfield data based on a performance measure associated with the weighted soundfield.

2. The apparatus of claim 1, wherein the compressor compresses the soundfield data, in a case where the performance measure associated with the weighted soundfield differs from a predefined performance measure threshold.

3. The apparatus of claim 1, wherein the performance measure associated with the weighted soundfield is an acoustical contrast between the at least one bright zone and the at least one quiet zone of the weighted soundfield.

4. The apparatus of claim 3, wherein the acoustical contrast between the bright zone and the quiet zone is obtained based on a ratio between an average of the weighted soundfield in the at least one bright zone and an average of the weighted soundfield in the at least one quiet zone.

5. The apparatus of claim 3, wherein the acoustical contrast between the at least one bright zone and the at least one quiet zone is obtained based on the following:

$$\epsilon(t) = 10\ \log_{10} \frac{\int_b |S(x,\ t)w(x)|^2 dx/D_b}{\int_q |S(x,\ t)w(x)|^2 dx/D_q},$$

wherein ∈(t) denotes the acoustical contrast as a function of time (t), S(x, t) denotes the soundfield data defining the soundfield as a function of a space and a time, w(x) denotes the spatially continuously varying weighting function and $D_b$ and $D_q$ denote a size of the at least one bright zone and a size of the at least one quiet zone, respectively.

6. The apparatus of according to claim 1, wherein the spatially continuously varying weighting function is a smoothly changing function that enhances the soundfield associated with the soundfield data in the at least one bright zone and the at least one quiet zone relative to a portion of the spatial reproduction region outside of the at least one bright zone and the at least one quiet zone.

7. The apparatus according to claim 1, wherein the spatially continuously varying weighting function is a linear combination of a first normal distribution centered at a center of the at least one bright zone and a second normal distribution centered at a center of the at least one quiet zone.

8. The apparatus according to claim 1, wherein the soundfield data is encoded in a Higher Order Ambisonic (HOA) B-Format.

9. The apparatus according to claim 1, wherein the apparatus further comprises a memory that stores the soundfield data to be weighted by the spatially continuously varying weighting function.

10. The apparatus according to claim 1 further comprising a renderer that renders the weighted soundfield based on the weighted soundfield data.

11. The apparatus of claim 1 further comprising:

a soundfield reproduction apparatus that receives the weighted soundfield data; and a renderer that renders the weighted soundfield based on the weighted soundfield data.

12. The apparatus of claim 11, wherein the soundfield reproduction apparatus further comprises a performance measure determiner that determines the performance measure based on the weighted soundfield and feeds back the performance measure associated with the weighted soundfield to the compressor.

13. A method for processing a soundfield data, the soundfield data defining a soundfield within a spatial reproduction region comprising an at least one bright zone and an at least one quiet zone, the method comprising:

applying a spatially continuously varying weighting function to the soundfield data to obtain a weighted soundfield data defining a weighted soundfield, wherein the spatially continuously varying weighting function enhances the soundfield in the at least one of the group consisting of: the at least one bright zone and the at least one quiet zone; and compressing the soundfield data based on a performance measure associated with the weighted soundfield.

14. The method of claim 13, wherein the performance measure associated with the weighted soundfield is an acoustical contrast between the at least one bright zone and the at least one quiet zone of the weighted soundfield.

15. The method of claim 14, wherein the acoustical contrast between the bright zone and the quiet zone is obtained based on a ratio between an average of the weighted soundfield in the at least one bright zone and an average of the weighted soundfield in the at least one quiet zone.

16. The method of claim 14, wherein the acoustical contrast between the at least one bright zone and the at least one quiet zone is obtained based on the following:

$$\epsilon(t) = 10 \log_{10} \frac{\int_b |S(x, t)w(x)|^2 dx/D_b}{\int_q |S(x, t)w(x)|^2 dx/D_q},$$

wherein ε(t) denotes the acoustical contrast as a function of time (t), S(x, t) denotes the soundfield data defining the soundfield as a function of a space and a time, w(x) denotes the spatially continuously varying weighting function and $D_b$ and $D_q$ denote a size of the at least one bright zone and a size of the at least one quiet zone, respectively.

17. A non-transitory computer readable storage medium having a computer-executable instructions that, when executed by a processor, facilitate carrying out a method for processing a soundfield data, the soundfield data defining a soundfield within a spatial reproduction region comprising an at least one bright zone and an at least one quiet zone, the method comprising:

applying a spatially continuously varying weighting function to the soundfield data to obtain a weighted soundfield data defining a weighted soundfield, wherein the spatially continuously varying weighting function enhances the soundfield in the at least one of the group consisting of: the at least one bright zone and the at least one quiet zone; and compressing the soundfield data based on a performance measure associated with the weighted soundfield.

18. The non-transitory computer-readable medium of claim 17, wherein the performance measure associated with the weighted soundfield is an acoustical contrast between the at least one bright zone and the at least one quiet zone of the weighted soundfield.

19. The non-transitory computer-readable medium of claim 18, wherein the acoustical contrast between the bright zone and the quiet zone is obtained based on a ratio between an average of the weighted soundfield in the at least one bright zone and an average of the weighted soundfield in the at least one quiet zone.

20. The non-transitory computer-readable medium of claim 18, wherein the acoustical contrast between the at least one bright zone and the at least one quiet zone is obtained based on the following:

$$\epsilon(t) = 10 \log_{10} \frac{\int_b |S(x, t)w(x)|^2 dx/D_b}{\int_q |S(x, t)w(x)|^2 dx/D_q},$$

wherein ε(t) denotes the acoustical contrast as a function of time (t), S(x, t) denotes the soundfield data defining the soundfield as a function of a space and a time, w(x) denotes the spatially continuously varying weighting function and $D_b$ and $D_q$ denote a size of the at least one bright zone and a size of the at least one quiet zone, respectively.

* * * * *